US008051695B2

(12) United States Patent
Ueoka et al.

(10) Patent No.: US 8,051,695 B2
(45) Date of Patent: Nov. 8, 2011

(54) METHOD FOR COOLING HOT STRIP

(75) Inventors: Satoshi Ueoka, Fukuyama (JP); Takashi Kuroki, Fukuyama (JP); Nobuo Nishiura, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 227 days.

(21) Appl. No.: 12/311,536

(22) PCT Filed: Oct. 25, 2007

(86) PCT No.: PCT/JP2007/071275

§ 371 (c)(1),
(2), (4) Date: Apr. 2, 2009

(87) PCT Pub. No.: WO2008/053947

PCT Pub. Date: May 8, 2008

(65) Prior Publication Data

US 2010/0192658 A1 Aug. 5, 2010

(30) Foreign Application Priority Data

Oct. 30, 2006 (JP) ..... 2006-293527

(51) Int. Cl.
*B21D 37/16* (2006.01)
*B21B 27/06* (2006.01)

(52) U.S. Cl. ..... 72/342.5; 72/201

(58) Field of Classification Search ..... 72/200, 72/201, 342.1–342.6, 342.94
See application file for complete search history.

(56) References Cited

FOREIGN PATENT DOCUMENTS

| | | | |
|---|---|---|---|
| EP | 1 634 657 | A1 | 3/2004 |
| JP | 58-071339 | A | 4/1983 |
| JP | 02-197312 | A | 8/1990 |
| JP | 06-071339 | A | 3/1994 |
| JP | 10-216821 | A | 8/1998 |
| JP | 2000-042621 | A | 2/2000 |
| JP | 2000-313920 | A | 11/2000 |
| JP | 2001-286925 | A | 10/2001 |
| JP | 2003-025009 | A | 1/2003 |
| JP | 2004-130353 | A | 4/2004 |
| JP | 2005-279703 | A | 10/2005 |
| JP | 2005-313223 | A | 11/2005 |
| WO | WO 2004/110661 | A1 | 12/2004 |

OTHER PUBLICATIONS

Kamioka et al., Machine Translation of JP 2005-279703, Oct. 13, 2005, pp. 1-28.*

* cited by examiner

*Primary Examiner* — Teresa Ekiert
(74) *Attorney, Agent, or Firm* — Holtz, Holtz, Goodman & Chick, PC

(57) ABSTRACT

The method for cooling a hot strip which is obtained after a hot rolling process to the temperature range of 500° or less. Cooling water is brought into contact with the hot strip. The method includes a first cooling step and a subsequent second cooling step. Cooling is stopped at a strip temperature that is higher than a transition boiling initiation temperature in the first cooling step, and the cooling is conducted using the cooling water having a water flow rate that causes nucleate boiling in the subsequent second cooling step. Entering the temperature range of transition boiling can be completely prevented to avoid thermal instability in cooling resulting from the transition boiling, and the temperature variation of the strip after cooling is controlled to be small while the cooling end temperature can be precisely controlled.

8 Claims, 6 Drawing Sheets

METHOD FOR COOLING HOT STRIP

This application is the United States national phase application of International Application PCT/JP2007/071275 filed Oct. 25, 2007.

TECHNICAL FIELD

The present invention relates to a method for cooling a hot strip after hot rolling by bringing cooling water into contact with the hot strip, and in particular, to a method for cooling a hot strip in which a cooling end temperature can be precisely controlled when the hot strip is cooled to 500° C. or less.

BACKGROUND ART

In a hot rolling process for manufacturing a hot strip, a slab heated to a high temperature is rolled so as to have a desired size and desired material properties, and then cooled with water on a run out table. The purpose of the water cooling is to obtain the desired material properties such as strength and ductility by mainly controlling the precipitates of the strip and the transformation structure of the strip. In particular, precisely controlling a cooling end temperature is significantly important to achieve the desired material properties without causing variation therefrom.

Although water, which is inexpensive, is often used as a cooling medium in a cooling step after hot rolling, use of such water cooling causes temperature variation of a strip at a low cooling end temperature or prevents precise stopping of the cooling at a desired temperature. The following factors are the main causes of these problems.

The first factor is a boiling state of water. In other words, cooling water boils when it comes into contact with a strip; however, the heat transfer performance of water changes at a certain temperature due to the conversion of the boiling state. When a hot strip is cooled lower than such a temperature, the cooling end temperature sometimes cannot be precisely controlled.

The boiling state of water in the case where a strip is cooled with water will now be described. Film boiling, nucleate boiling, and transition boiling occur, respectively, when the surface of a strip to be subjected to water is in a high temperature range, in a low temperature range, and in a middle temperature range between the high temperature range and the low temperature range. In the film boiling that occurs in a high temperature range, a vapor film is formed between the surface of a strip and cooling water. Since heat is transferred through thermal conduction within the vapor film, the cooling performance is low. In the nucleate boiling that occurs in a low temperature range, on the other hand, cooling water comes into direct contact with the surface of a strip and the cooling water is stirred due to the complicated phenomenon of the formation and disappearance of vapor bubbles, in which part of the cooling water vaporizes from the surface of a strip to form vapor bubbles and then the vapor bubbles are immediately condensed by the surrounding cooling water to disappear. As a result, significantly high cooling performance is achieved. In a middle temperature range, transition boiling in which the film boiling and the nucleate boiling coexist occurs. Unlike the nucleate boiling and the film boiling, heat flux increases as strip temperature decreases in this transition boiling. In terms of controlling material properties, the cooling rate should not vary with temperature. Furthermore, when cooling is stopped (ended) in a temperature range where the conversion from film boiling to transition boiling occurs, even a slightly long control time for cooling causes a problem in that the strip temperature is considerably lowered from a desired temperature because the cooling rate increases at an accelerated pace in a transition boiling temperature range.

In the case where a strip before cooling has locally low-temperature regions due to, for example, hot rolling, the transition boiling occurs first in these low-temperature regions during cooling, which causes further temperature deviation. In a cooling step conducted on a general run out table, such transition boiling begins at about 500° C.

The second factor is residual cooling water on a strip. Although laminar cooling is conducted using round or slit type nozzles when the upper side of a strip is cooled on a general run out table, cooling water that collides with the upper side of the strip flows in a direction of movement of the strip while being left on the strip. Normally, cooling water on the upper side of the strip is drained by being purged. In a conventional method, however, cooling water is purged at a position distant from the place where the cooling water is supplied. Therefore, only the part where the cooling water is left on the surface of the strip is excessively cooled before the cooling water is purged. In particular, in the low temperature range of 500° C. or less, the cooling performance of the cooling water becomes high due to the conversion of the boiling state from the film boiling to the transition boiling, resulting in a large temperature deviation between the regions where residual cooling water exists and the regions where residual cooling water does not exist.

From the reasons described above, the temperature in a coil is significantly varied when cooling of a hot strip is stopped at 500° C. or less, which is a transition boiling initiation temperature. Thus, various methods have been examined to deal with the above-mentioned phenomena.

For example, a method for supplying cooling water to both the upper and lower sides of a hot strip in the high temperature range where film boiling occurs, and supplying the cooling water to only the lower side of the strip in the temperature range of transition boiling is disclosed in Patent Document 1. In this cooling method, residual cooling water on the upper side of the strip and the thermal instability in cooling caused by the residual cooling water are removed by cooling only the lower side in the temperature range of transition boiling, to realize stable cooling.

A method for conducting cooling using low-temperature cooling water first, and then conducting cooling using cooling water having a high temperature of 80° C. or more from the temperature range of transition boiling is disclosed in Patent Document 2. In this cooling method, the transition boiling initiation temperature is shifted to the low temperature side by using hot water as cooling water, thereby lengthening the duration of film boiling, to realize stable cooling.

A method for disposing a water cooling apparatus together with a gas cooling apparatus, conducting water cooling with the water cooling apparatus in a high temperature range, and conducting gas cooling with the gas cooling apparatus in a temperature range that is lower than the transition boiling initiation temperature is disclosed in Patent Document 3. In this cooling method, the gas cooling that does not cause a boiling phenomenon and shows a stable cooling performance in the low temperature range is used to realize temperature stability in the low temperature range.

A method for conducting cooling to about 400° C. with hot water of 80 to 100° C. in the first half of a run out table, and then conducting cooling with cooling water having a temperature lower than that used in the first half of a run out table is disclosed in Patent Document 4. In this cooling method, the transition boiling initiation temperature is shifted to the low temperature side by using hot water as cooling water in the first half of a run out table, and cooling is conducted with cooling water that is cold enough to cause nucleate boiling in the low temperature range, to realize temperature stability in the low temperature range.

The following cooling apparatus is disclosed in Patent Document 5. In this cooling apparatus, a cooling zone where cooling water is supplied to continuously cool a strip after hot finishing rolling is divided into a first zone and a second zone. A cooling device with a high cooling performance (water flow rate: 1.0 to 5.0 $m^3/m^2 \cdot min$) is disposed in the first zone and a cooling device with a low cooling performance (water flow rate: 0.05 $m^3/m^2 \cdot min$ to less than 0.3 $m^3/m^2 \cdot min$) is disposed in the second zone. In addition, a cooling device with a middle cooling performance (water flow rate: 0.3 $m^3/m^2 \cdot min$ to less than 1.0 $m^3/m^2 \cdot min$) is disposed throughout the cooling zone. In the cooling of a hot strip with such a cooling apparatus, the transition boiling initiation temperature is shifted to the low temperature side by decreasing the amount of cooling water in the low temperature range, thereby lengthening the duration of film boiling to realize stable cooling.

Patent Document 1: Japanese Examined Patent Application Publication No. 6-248

Patent Document 2: Japanese Unexamined Patent Application Publication No. 6-71339

Patent Document 3: Japanese Unexamined Patent Application Publication No. 2000-313920

Patent Document 4: Japanese Unexamined Patent Application Publication No. 58-71339

Patent Document 5: Japanese Unexamined Patent Application Publication No. 2003-25009

DISCLOSURE OF INVENTION

However, the methods of the related art described above include the following practical problems.

In the method described in Patent Document 1, the temperature variation due to residual cooling water on the upper side of a strip can be reduced. However, entering the temperature range of transition boiling where thermal instability in cooling occurs is not prevented by simply supplying cooling water to the lower side of the strip. Therefore, the precision with which the cooling end temperature can be controlled is lowered.

In the method described in Patent Document 2, although the transition boiling initiation temperature can be shifted to the low temperature side by using hot water, the effect is limited. When the cooling end temperature is controlled to be even lower, entering the temperature range of transition boiling where thermal instability in cooling occurs is not prevented. Therefore, the precision with which the cooling end temperature can be controlled is lowered. Moreover, the effect of the residual cooling water on the strip is not taken into account, which inevitably causes temperature deviation.

In the method described in Patent Document 3, since gas cooling that does not cause a boiling phenomenon and thermal instability in cooling is conducted, the precision with which the cooling end temperature can be controlled can be improved. However, the gas cooling has a cooling performance lower than water cooling by one or two orders of magnitude. Therefore, the cooling rate is significantly low and desired material properties cannot be obtained. The low cooling rate by the gas cooling also requires a very long and large cooling apparatus for run out cooling of a hot strip. It is quite difficult to realize this method.

In the method described in Patent Document 4, the temperature of cooling water is set to be rather high, which is 80° C. or more, in the first cooling (in the first half of a run out table), while the temperature of cooling water is set to be low in the second cooling. In other words, film boiling is used in the first cooling and nucleate cooling is used in the second cooling. This method is very effective to avoid transition boiling that causes thermal instability in cooling, but requires a huge amount of hot water in the first cooling. That is, the amount of cooling water per unit area normally used in a run out table is often about 0.7 to 1.2 $m^3/min \cdot m^2$ whereas the amount of cooling water ejected to a strip in this method is about 100 $m^3/min$, which is a huge amount. In the method described in Patent Document 4, a significantly large-scale apparatus for producing hot water by heating a large amount of water and enormous energy for heating the water are required, which means this method is not practical. Furthermore, although the temperature of cooling water is designed to be decreased to cause nucleate boiling in the low temperature range, it is very difficult to cause stable nucleate boiling by simply adjusting the water temperature. It is practically difficult to realize stable cooling using this method. The effect of the residual cooling water on the strip is also not taken into account, which inevitably causes temperature deviation.

In the cooling conducted in accordance with Patent Document 5, the amount of cooling water is decreased in the zone where a strip temperature has been lowered. The physically obtained effect is to shift the transition boiling initiation temperature to the low temperature side. However, although the transition boiling initiation temperature can be shifted to the low temperature side by decreasing the amount of cooling water, the effect is limited. When the cooling end temperature is controlled to be even lower, entering the temperature range of transition boiling where thermal instability in cooling occurs is not prevented. Therefore, the precision with which the cooling end temperature can be controlled is lowered. Moreover, the effect of the residual cooling water on the strip is not taken into account, which inevitably causes temperature deviation.

An object of the present invention is to provide a method for solving the problems of the related art described above with less facilities and processing costs, and specifically, a method for cooling a hot strip in which the temperature variation of a strip after cooling is controlled to be small and a cooling end temperature can be precisely controlled particularly when the hot strip is cooled to the temperature range of 500° C. or less.

The inventors of the present invention paid attention to the fact that the higher a water flow rate of cooling water supplied to a hot strip was, the higher a transition boiling initiation temperature and a nucleate boiling initiation temperature became; and found that entering the temperature range of transition boiling could be completely prevented to avoid thermal instability in cooling resulting from the transition boiling, by stopping cooling at a strip temperature that is higher than a transition boiling initiation temperature in the cooling step (first cooling step) on the high temperature side, and then conducting cooling with the cooling water having a cooling water flow rate that causes nucleate boiling in the cooling step (second cooling step) on the low temperature side.

The present invention is based on the findings described above and its summary is as follows.

[1] A method for cooling a hot strip, which is obtained after a hot rolling process, by bringing cooling water into contact with the hot strip, including a first cooling step and a subsequent second cooling step, wherein cooling is stopped at a strip temperature that is higher than a transition boiling initiation temperature in the first cooling step, and the cooling is conducted using the cooling water having a water flow rate that causes nucleate boiling in the subsequent second cooling step.

[2] The method for cooling a hot strip according to the above-mentioned [1], wherein the cooling is conducted using the cooling water having a water flow rate of 350 to 1200 L/min·m$^2$ and is stopped at a strip temperature of more than 500° C. in the first cooling step, and the cooling water having a water flow rate of 2000 L/min·m$^2$ or more is supplied to at least an upper side of the strip to decrease the strip temperature to 500° C. or less in the subsequent second cooling step.

[3] The method for cooling a hot strip according to the above-mentioned [1], wherein the cooling is conducted using the cooling water having a water flow rate of more than 1200 L/min·m$^2$ in the early stage of the first cooling step, and the cooling is then conducted using the cooling water having a water flow rate of 350 to 1200 L/min·m$^2$ and is stopped at a strip temperature of more than 500° C. in the later stage of the first cooling step; and the cooling water having a water flow rate of 2000 L/min·m$^2$ or more is supplied to at least an upper side of the strip to decrease the strip temperature to 500° C. or less in the subsequent second cooling step.

[4] The method for cooling a hot strip according to the above-mentioned [2] or [3], wherein the cooling is stopped at a strip temperature of 550 to 600° C. in the first cooling step, and the cooling water having a water flow rate of 2500 L/min·m$^2$ or more is supplied to at least the upper side of the strip in the subsequent second cooling step.

[5] The method for cooling a hot strip according to any one of the above-mentioned [2] to [4], wherein at least the upper side of the strip is cooled by laminar cooling or jet cooling while a velocity at which the cooling water is ejected from cooling water supply nozzles by the laminar cooling or the jet cooling is 7 m/sec or more in the second cooling step.

[6] The method for cooling a hot strip according to any one of the above-mentioned [1] to [5], wherein the cooling water supplied to the upper side of the strip is drained toward the outside of the strip in its side directions using water purging means in the second cooling step.

[7] The method for cooling a hot strip according to the above-mentioned [6], wherein the water purging means is a roller disposed on the upper side of the strip in its width direction.

[8] The method for cooling a hot strip according to the above-mentioned [6], wherein the water purging means is a high-pressure fluid that is ejected to the cooling water on the upper side of the strip.

[9] The method for cooling a hot strip according to any one of the above-mentioned [1] to [5], wherein the cooling water is supplied to the upper side of the strip such that the cooling water ejected from two cooling water supply nozzles or two groups of cooling water supply nozzles collides with the upper side of the strip from obliquely above while obliquely facing the strip in a strip processing line direction, and both streams of the cooling water then collide with each other on a surface of the strip.

In the cooling method of the present invention, entering the temperature range of transition boiling can be prevented to completely avoid thermal instability in cooling resulting from the transition boiling. Thus, the temperature variation of a strip after cooling is controlled to be small and a cooling end temperature can be precisely controlled. In particular, the cooling end temperature can be precisely controlled when the hot strip is cooled to the temperature range of 500° C. or less, which has been difficult in the related art. Regarding a hot strip coiled at 500° C. or less, there has been the variation of material properties such as strength and ductility in the related art. However, the variation of material properties is reduced and the material properties can be controlled within a narrow range.

REFERENCE NUMERALS IN THE DRAWINGS DENOTE THE FOLLOWING

| | |
|---|---|
| 1 | group of finishing stands |
| 2 | run out table |
| 3 | coiler |
| 4a and 4b | cooling water supply means |
| 5 and 5a to 5c | cooling water supply nozzles |
| 6 | ejected water beams |
| 7, 7a and 7b | water purging rollers |
| 8a and 8b | ejecting nozzles |
| 9 | high-pressure fluid |
| 10 | radiation thermometers |
| 20 | first run out table |
| 21 | second run out table |
| A1 to A5 | groups of nozzles |
| S | strip |

BEST MODE FOR CARRYING OUT THE INVENTION

In the present invention, a method for cooling a hot strip, which is obtained after a hot rolling process, by bringing cooling water into contact with the hot strip includes a first cooling step and a second cooling step that follows the first cooling step. In the first cooling step, cooling is stopped at a strip temperature that is higher than a transition boiling initiation temperature. In the second cooling step that follows the first cooling step, the cooling is conducted using the cooling water having a water flow rate that causes nucleate boiling.

Note that a strip temperature means the surface temperature of a strip in the present invention.

Figure 1A:
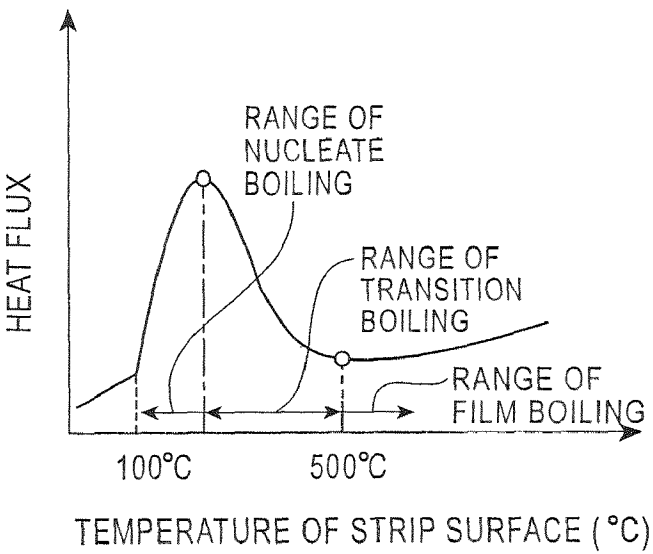
PRIOR ART FIG. 1A
FIGS. 1A and 1B are explanatory diagrams schematically showing a relationship between the surface temperature of a strip and heat flux when the hot strip is cooled with cooling water.
Figure 1B:
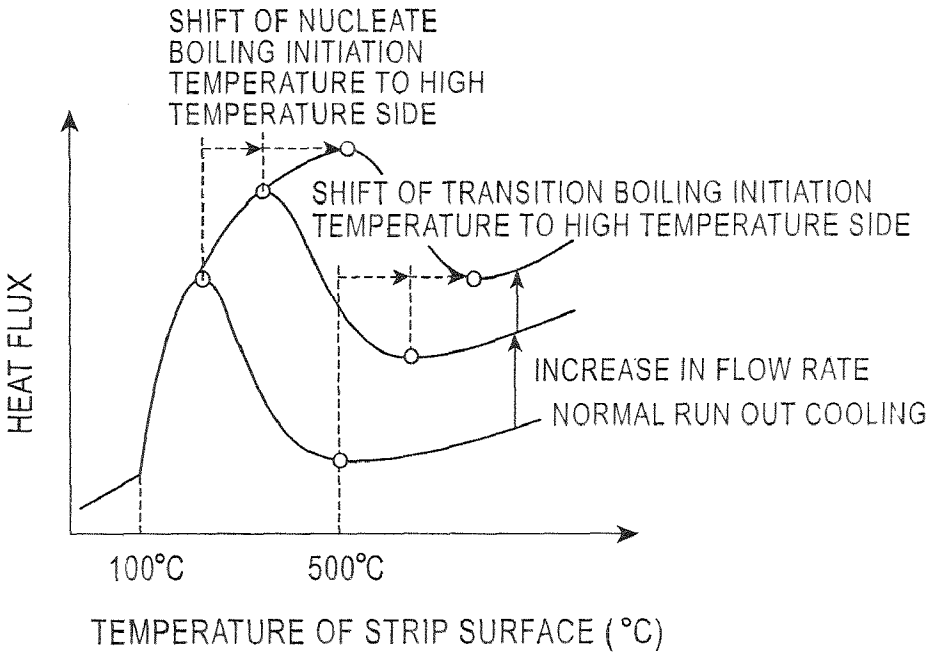
PRIOR ART FIG. 1B

FIGS. 1A and 1B schematically show a relationship between the surface temperature of a strip and heat flux (an amount of heat taken from a strip) when the strip is cooled by supplying cooling water. FIG. 1A shows heat flux and a boiling state of water in run-out cooling with a normal cooling water flow rate. FIG. 1B shows a change in heat flux and a boiling state when the cooling water flow rate is increased compared to such normal run-out cooling conditions. According to the drawings, film boiling occurs and heat flux is low in the range of a high surface temperature of a strip. In terms of heat transfer characteristics, the higher a cooling water flow rate is, the higher a transition boiling initiation temperature and a nucleate boiling initiation temperature become. Accordingly, by separating a run-out cooling step into a cooling step on the high temperature side (first cooling step) and the following cooling step on the low temperature side (second cooling step), cooling is stopped at a strip temperature that is higher than a transition boiling initiation temperature in the cooling step on the high temperature side, and the cooling is conducted using the cooling water having a high water flow rate that causes nucleate boiling in the following cooling step on the low temperature side. Thus, cooling can be conducted without entering the temperature range of transition boiling.

As shown in FIGS. 1A and 1B, transition boiling occurs at about 500° C. and heat flux increases as strip temperature decreases in normal run-out cooling. Therefore, if normal run-out cooling is conducted to about 500° C. as the cooling step on the high temperature side (first cooling step), and cooling is then conducted completely within the temperature range of nucleate boiling by increasing the cooling water flow rate in the following cooling step on the lower temperature side, transition boiling does not occur in run-out cooling and the cooling end temperature can be precisely controlled.

Figure 2:
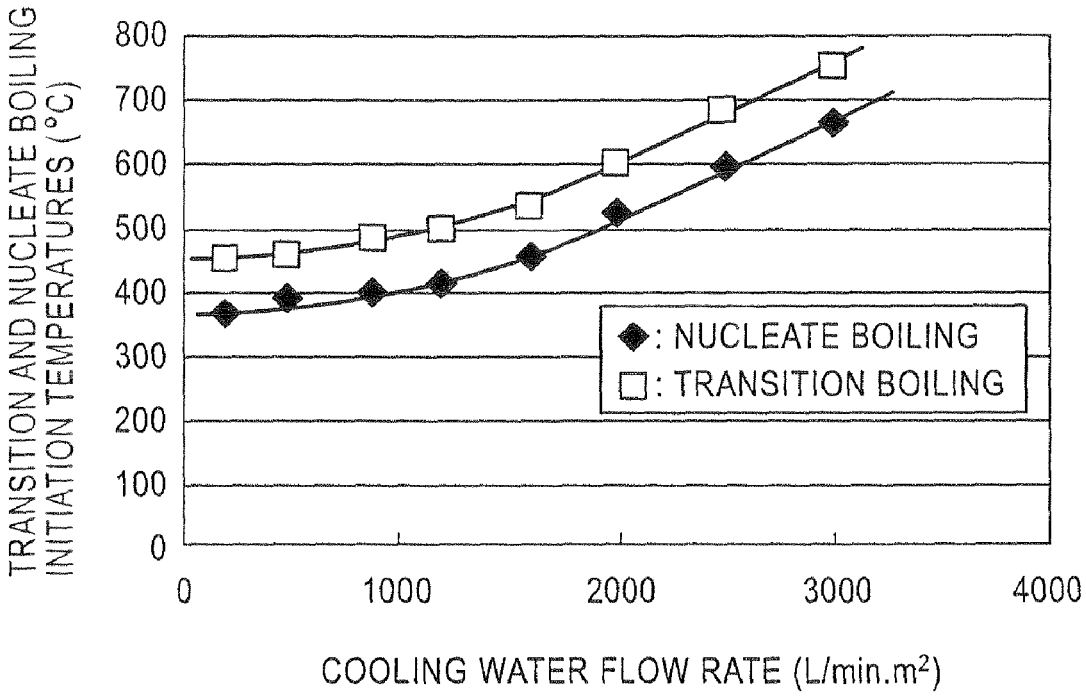
PRIOR ART FIG. 2
FIG. 2 is a graph showing a relationship between a cooling water flow rate and transition boiling and nucleate boiling initiation temperatures when a hot strip is cooled with cooling water.

An experimentally obtained relationship between a cooling water flow rate and transition boiling and nucleate boiling initiation temperatures will now be described. In a laboratory, jet cooling was conducted using a plurality of round type nozzles arrayed in the width and longitudinal directions of a strip. In the experiment, the cooling water flow rate (an amount of cooling water supplied per unit area) was changed to examine the transition boiling and nucleate boiling initiation temperatures from the cooling temperature history. The result is shown in FIG. 2. As is evident from the result, the transition boiling and nucleate boiling initiation temperatures increase as the cooling water flow rate becomes high, and the cooling water flow rate should be 2000 L/min·m$^2$ or more to make the nucleate boiling initiation temperature 500° C. or more. It is also obvious that, in a cooling water flow rate of 1200 L/min·m$^2$ or less (350 to 1200 L/min·m$^2$), which is the flow rate of normal run-out cooling, the transition boiling initiation temperature is about 500° C. or less.

From the result described above, in the first cooling step (the cooling step on the high temperature side), cooling is conducted with a cooling water flow rate of 350 to 1200 L/min·m$^2$, which is a normal run-out cooling condition, to stop the cooling at a strip temperature of more than 500° C. In the following second cooling step (the cooling step on the low temperature side), cooling is conducted with a cooling water flow rate of 2000 L/min·m$^2$ or more, which almost certainly causes nucleate boiling, until the strip temperature decreases to 500° C. or less. Consequently, cooling can be conducted without entering the temperature range of transition boiling. This does not cause the cooling variation of the strip and can stabilize and precisely control the cooling end temperature.

Although transition boiling occurs at about 500° C. under normal run-out conditions applied to a hot strip, the transition boiling temperature is varied to a certain extent, depending on the properties of a strip surface. To avoid entering the temperature range of transition boiling with more certainty, cooling is preferably stopped at a strip temperature rather higher than 500° C. in the first cooling step, and cooling is preferably conducted with rather a higher cooling water flow rate than 2000 L/min·m$^2$ in the following second cooling step. Specifically, the cooling is more preferably stopped at a strip temperature of 550 to 600° C. in the first cooling step, and the cooling is more preferably conducted with a cooling water flow rate of 2500 L/min·m$^2$ or more in the second cooling step.

The cooling water with a water flow rate of 2000 L/min·m$^2$ or more, preferably 2500 L/min·m$^2$ or more, in the second cooling step mentioned above is preferably supplied to at least the upper side of the strip. On the other hand, unlike the upper side of the strip, the temperature variation due to residual cooling water does not occur on the lower side of the strip. Therefore, the cooling water with a cooling water flow rate of 2000 L/min·m$^2$ or more, which is supplied to the upper side of the strip, is not necessarily supplied to the lower side of the strip. However, since temperature variation may increase in the case where there are locally low-temperature regions on the strip, the water flow rate of the cooling water supplied to the lower side of the strip should be 2000 L/min·m$^2$ or more, preferably 2500 L/min·m$^2$ or more, as with the upper side of the strip.

In the present invention, the condition required in the first cooling step is to stop cooling at a strip temperature higher than a transition boiling initiation temperature. There is no problem even if the cooling water flow rate is suitably changed in the first cooling step. The cooling water flow rate may be decreased in the order of an early stage and a later stage of the first step, for example, to adjust material properties or shorten cooling time. Specifically, cooling is conducted with a cooling water flow rate of more than 1200 L/min·m$^2$, which is higher than that of a normal run-out cooling condition, in the early stage of the first cooling step, and cooling is then conducted with a cooling water flow rate of 350 to 1200 L/min·m$^2$, which is a normal run-out cooling condition, and is stopped at a strip temperature higher than 500° C. (preferably 550 to 600° C.) in the later stage of the first cooling step. Subsequently, the second cooling step is conducted in accordance with the conditions described above.

Referring to FIG. 2, when cooling is conducted, as in the method described in Patent Document 5, with a water flow rate of 0.05 to 0.3 m$^3$/min·m$^2$ (50 to 300 L/min·m$^2$) on the second run out table, stable cooling can be conducted to 400° C. because the transition boiling initiation temperature is decreased to about 400° C. However, since cooling is conducted within the temperature range of transition boiling at a temperature of 400° C. or less, the temperature variation after cooling and a drop in precision with which the cooling end temperature can be controlled cannot be prevented. In the preferred embodiment of the present invention, on the other hand, since cooling on the low temperature side can be conducted completely within the temperature range of nucleate boiling, the temperature variation after cooling and a drop in precision with which the cooling end temperature can be controlled can be prevented no matter how the cooling end temperature is lowered.

Figure 3:
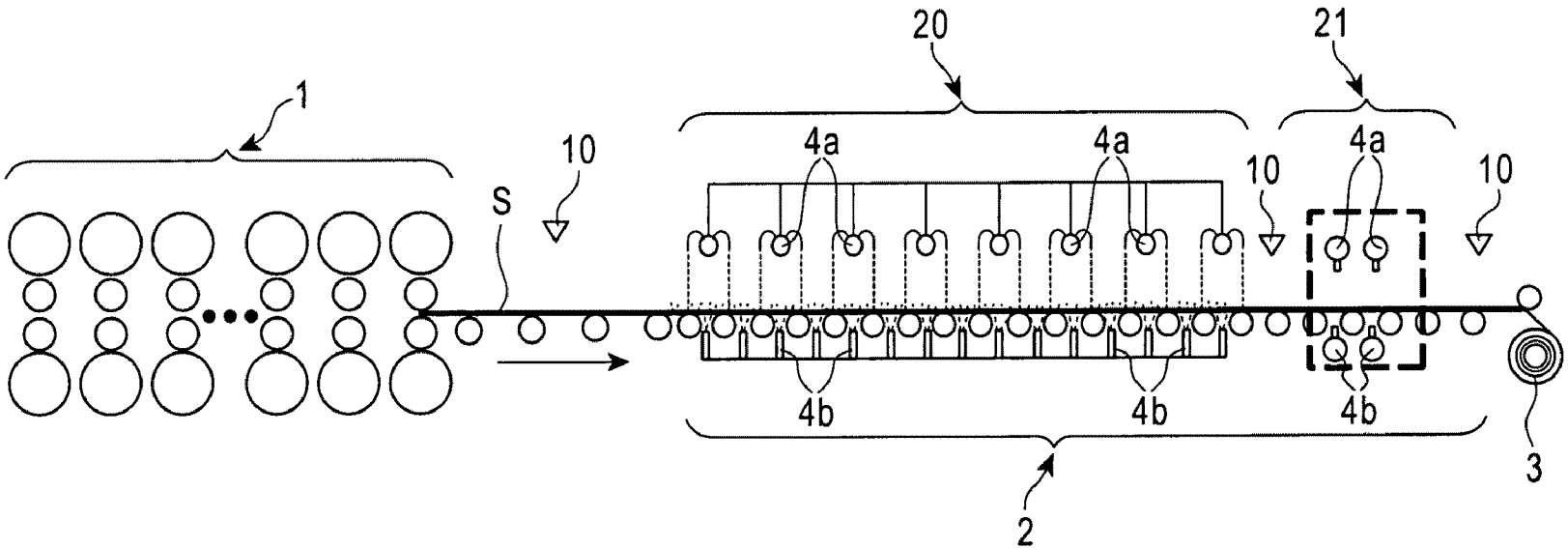
FIG. 3 is an explanatory diagram showing one example of a hot strip manufacturing line used to implement the present invention and showing how the present invention is implemented in the manufacturing line.

FIG. 3 is one example of a hot strip manufacturing line used to implement the present invention, and shows how the present invention is implemented in the manufacturing line. In this hot strip manufacturing line, after a strip S (hot strip) rolled with a group of finishing stands 1 so as to have a thickness for end products is cooled to a predetermined temperature on a run out table 2, the strip S is wound with a coiler 3. Cooling water is supplied to the upper and lower sides of, the strip S conveyed on the run out table 2, from cooling water supply means 4*a* disposed above the run out table 2 and cooling water supply means 4*b* disposed between table rollers, respectively. Non-limiting examples of the cooling water supply means 4*a* and 4*b* include cooling water supply nozzles (e.g., round or slit type nozzles for laminar cooling or jet cooling, or spray nozzles for spraying cooling).

The run out table 2 is constituted by an upstream run out table section 20 (hereinafter referred to as "first run out table 20" for convenience) and a down stream run out table section 21 (hereinafter referred to as "second run out table 21" for convenience). The first cooling step (the cooling step on the high temperature side) is conducted on the first run out table 20, and the second cooling step (the cooling step on the low temperature side) is then conducted on the second run out table 21. In FIG. 3, reference numeral 10 denotes radiation thermometers for measuring strip temperatures that are disposed between the group of finishing stands 1 and the first run out table 20, between the first run out table 20 and the second run out table 21, and between the run out table 2 and the coiler 3.

The method for cooling a strip by bringing cooling water into contact with the strip includes laminar cooling, spraying cooling, jet cooling, and mist cooling. The laminar cooling is a cooling method in which a continuous flow of liquid with a laminar flow is ejected from round or slit type nozzles. The spraying cooling is a cooling method in which a pressurized liquid is ejected as droplets. The jet cooling is a cooling method in which a continuous flow of liquid with a turbulent state is ejected from round or slit type nozzles. The mist cooling is a cooling method in which droplets are made by mixing pressurized gas and liquid to atomize the liquid.

In the present invention, although a cooling method that is employed is not particularly limited, the laminar cooling or the jet cooling in which the ejected cooling water is excellent in terms of straightness and has a continuous flow is preferable as a method for cooling the upper side of the strip.

Figure 4:
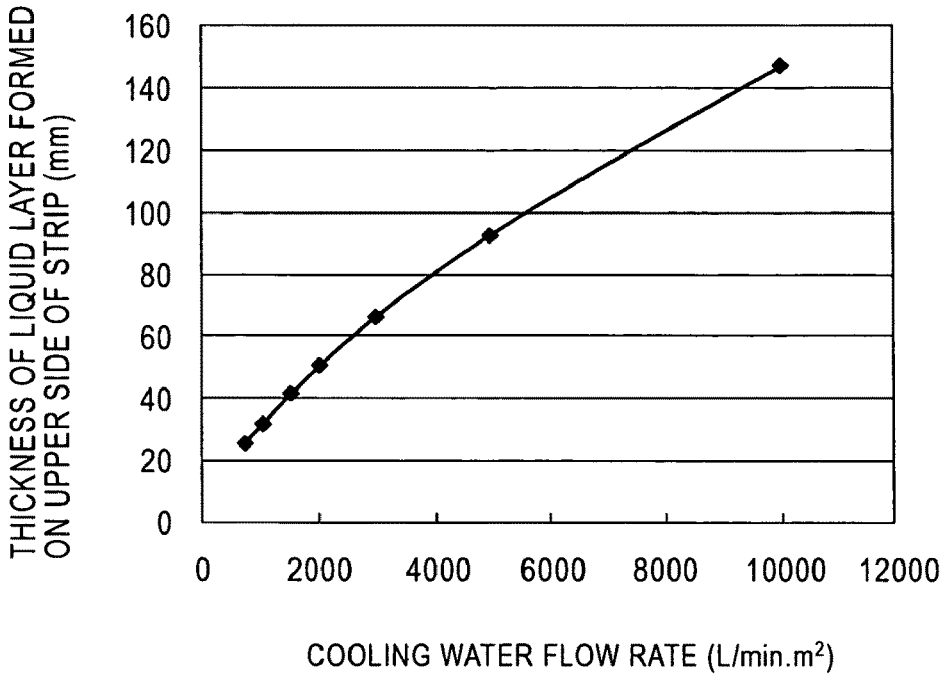
FIG. 4 is a graph showing a relationship between a cooling water flow rate and the thickness of a liquid layer formed on the upper side of a strip when the hot strip is cooled with cooling water.

In the preferred embodiment of the present invention described above, cooling water with a cooling water flow rate of 2000 L/min·m$^2$ or more, preferably 2500 L/min·m$^2$ or more, needs to be supplied to the strip in the second cooling step. However, in the case where this amount of water is supplied to the strip, a thick liquid layer is formed on the strip because the cooling water is drained only in the side directions of the strip. Moreover, the cooling water needs to be supplied so as to penetrate the liquid layer and exert a striking force directly on the strip; otherwise film boiling may occur even if a large amount of cooling water is supplied. FIG. 4 shows a relationship between the water flow rate of cooling water and the thickness of a liquid layer formed on the upper side of a strip, which is obtained in the experiment of supplying cooling water on the upper side of a strip having a width of 2 m. As is evident from the result, supplying cooling water with a water flow rate of 2000 L/min·m$^2$ or more results in the formation of a liquid layer having a thickness of nearly 50 mm. To penetrate such a liquid layer, the laminar cooling or the jet cooling in which the ejected cooling water is excellent in terms of straightness and has a continuous flow is preferable. In spraying cooling or mist cooling, cooling water ejected from nozzles is atomized into droplets. Since the cooling water in such a droplet form easily reduces its velocity due to an increase in air resistance, the spraying cooling or mist cooling is unsuitable for penetrating the liquid layer.

Either round or slit type nozzles can be used as the cooling water supply nozzles for the laminar cooling or the jet cooling.

When the upper side of the strip is cooled with cooling water having a water flow rate of 2000 L/min·m$^2$ or more, preferably 2500 L/min·m$^2$ or more by the laminar cooling or the jet cooling, the velocity (the velocity of flow of cooling water at a nozzle orifice) at which the cooling water is ejected from round or slit type nozzles is preferably 7 m/sec or more. As described above, a velocity of 7 m/sec or more is required to obtain kinetic momentum that stably penetrates the liquid layer on the upper side of the strip by the laminar cooling or the jet cooling.

On the other hand, cooling water supplied to the lower side of the strip immediately falls from the surface of the strip due to gravity and a liquid layer is not formed on the surface of the strip. Therefore, a cooling method such as spraying cooling may be used. Even when the laminar cooling or the jet cooling is used, the velocity at which cooling water is ejected may be less than 7 m/sec.

Since the size of a round type nozzle is small and the amount of water ejected from one nozzle is low, a plurality of nozzles should be arrayed in the width and longitudinal directions of the strip to obtain a predetermined water flow rate. The hole diameter of round type nozzles and the slit gap of slit type nozzles are preferably about 3 to 25 mm. When the diameter or the slit gap of such nozzles is less than 3 mm, the nozzles are likely to be clogged with dust. When the diameter or the slit gap is more than 25 mm, an uneconomically large amount of flow is necessary to achieve the velocity described above (7 m/sec or more) at which cooling water is ejected.

Since residual cooling water on the upper side of the strip, locally and excessively, cools the upper side and cooling variation occurs, the cooling water supplied to the upper side of the strip is preferably removed immediately. Therefore, at least one of the following measures is preferably taken: (i) cooling water is supplied so as not to be left on the upper side of the strip; and (ii) cooling water supplied to the upper side of the strip is forcedly drained toward the outside of the strip in its side directions using water purging means.

In the method (i) described above, cooling water is supplied to the upper side of the strip from cooling water supply nozzles such that cooling water ejected from two cooling water supply nozzles or two groups of cooling water supply nozzles by the laminar cooling, the jet cooling, or the like collides with the upper side of the strip from obliquely above while obliquely facing the strip in a strip processing line direction, and both streams of the cooling water then collide with each other on the surface of the strip. In such a water-supplying form, since both the streams of the cooling water collide with each other on the surface of the strip, cooling water is forced out in the width directions of the strip and immediately drained toward the outside of the strip in its side directions. Accordingly, the cooling water supplied to the upper side of the strip is immediately removed from the upper side of the strip without being left as residual cooling water.

Figure 5:
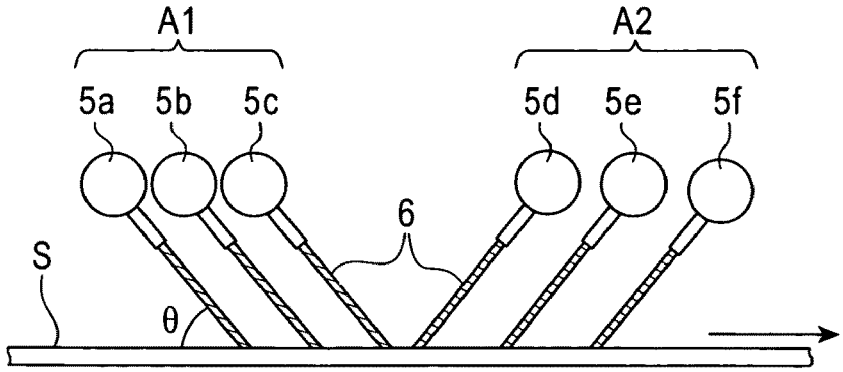
FIG. 5 is an explanatory diagram showing one embodiment of supplying cooling water in the present invention.

FIG. 5 shows one of the embodiments. Two groups of nozzles A1 and A2 for the laminar cooling or the jet cooling are arrayed in a strip processing line direction. These two groups of nozzles A1 and A2 are respectively constituted by three cooling water supply nozzles 5*a* to 5*c* and three cooling water supply nozzles 5*d* to 5*f* (e.g., round type nozzles or slit type nozzles) arrayed in the strip processing line direction with a certain space. Ejected water beams 6 of cooling water from these two groups of nozzles A1 and A2 collide with the upper side of the strip S from obliquely above while obliquely facing the strip in a strip processing line direction, and both the streams of the cooling water then collide with each other on the surface of the strip. As a result, the cooling water is forced out in the width directions of the strip and immediately drained toward the outside of the strip in its side directions. In the embodiment shown in FIG. 5, although cooling water is supplied such that two streams of the cooling water ejected from the two groups of nozzles A1 and A2 collide with each other on the surface of the strip, cooling water may be supplied such that two streams of the cooling water ejected from two cooling water supply nozzles 5 collide with each other on the surface of the strip.

The smaller the angle θ between the surface of the strip and the ejected water beams 6 that collide with the upper side of the strip S from obliquely above is, the more cooling water is drained, resulting in a decrease in residual cooling water on the strip. In the case where the angle θ exceeds 60°, although cooling water (residual cooling water) that has reached the strip flows on the surface of the strip, the velocity component in the flow direction becomes small and a flow in the opposite direction is generated. Consequently, in the case of, for example, the cooling water supply nozzles 5 that eject cooling water from the upstream side to the downstream side in the direction of movement of the strip, part of the residual cooling water flows out to the more upstream side than the position (the position of the collision) where the ejected water beams 6 have reached, and there may be a risk of not being cooled uniformly. In the case of, for example, the groups of nozzles A1 and A2 shown in FIG. 5, part of the residual cooling water may flow out to the more upstream side than the position (the position of the collision) where the ejected water beam 6 from the cooling water supply nozzle 5*a* disposed at the most upstream side among the group of nozzles A1 has reached. Therefore, the angle θ is preferably 60° or less, more preferably 50° or less so that two streams resulting from two (two groups of) water beams that have collided with the upper side of the strip flow with certainty in the respective directions and both the streams collide with each other on the surface of the strip. However, when the angle θ is less than 45°, particularly less than 30° or less, the distance between the cooling water supply nozzles 5 and the strip S becomes too large and the ejected water beams 6 are dispersed because the sufficiently high position of the cooling water supply nozzles 5 relative to the strip S needs to be maintained. Since this may decrease the cooling performance, the angle θ is preferably 30° or more, more preferably 45° or more.

In the method (ii) described above, water purging means that can, immediately (that is, as close as possible to the position where cooling water is supplied) and forcedly, drain cooling water supplied to the upper side of the strip toward the outside of the strip in its side directions is preferably used. Examples of such water purging means include rollers for purging water disposed on the upper side of the strip in its width direction. In other words, cooling water supplied to the upper side of the strip is dammed up with the rollers on the upper side of the strip, which forces the cooling water to flow in the width directions of the strip. As a result, the cooling water is forcedly drained toward the outside of the strip in its side directions.

Figure 6:
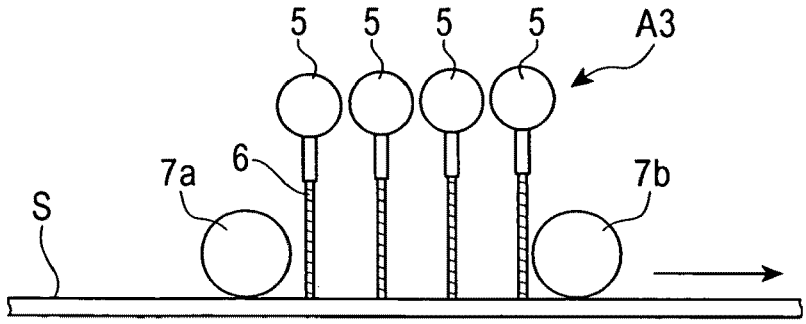
FIG. 6 is an explanatory diagram showing one embodiment of cooling water purging means in the present invention.

FIG. 6 shows one embodiment where rollers are used as water purging means. Water purging rollers 7*a* and 7*b* are respectively disposed on the upstream side and the downstream side of the strip processing line, relative to the position where cooling water is supplied from a group of nozzles A3 constituted by a plurality of the cooling water supply nozzles 5 for the laminar cooling or the jet cooling. Cooling water (vertically supplied cooling water in this embodiment) supplied from the group of nozzles A3 is dammed up between the water purging rollers 7*a* and 7*b*, which forces the cooling water to flow in the width directions of the strip S. As a result, the cooling water is forcedly drained toward the outside of the strip in its side directions.

Figure 7:
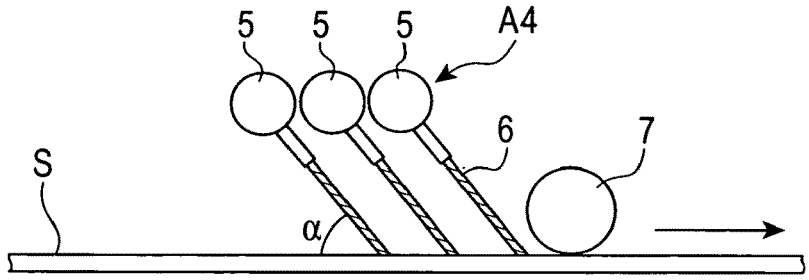
FIG. 7 is an explanatory diagram showing another embodiment of cooling water purging means in the present invention.

FIG. 7 shows another embodiment when rollers are used as water purging means. A water purging roller 7 is disposed on the downstream side of the strip processing line, relative to the position where cooling water is supplied from a group of nozzles A4 constituted by a plurality of the cooling water supply nozzles 5 for the laminar cooling or the jet cooling. The cooling water is obliquely supplied from the group of nozzles A4 to the downstream side of the strip processing line. The cooling water supplied from the group of nozzles A4 is dammed up with the water purging roller 7, which forces the cooling water to flow in the width directions of the strip S. As a result, the cooling water is forcedly drained toward the outside of the strip in its side directions.

Alternatively, a high-pressure fluid (e.g., high-pressure gas or high-pressure water) can be used as water purging means. Cooling water is dammed up by ejecting a high-pressure fluid, from obliquely above in the strip processing line direction, to the cooling water that is supplied on the upper side of the strip and flows on the surface of the strip, which forces the cooling water to flow in the width directions of the strip. As a result, the cooling water is forcedly drained toward the outside of the strip in its side directions. Examples of the high-pressure fluid include high-pressure water and gases such as air.

Figure 8:
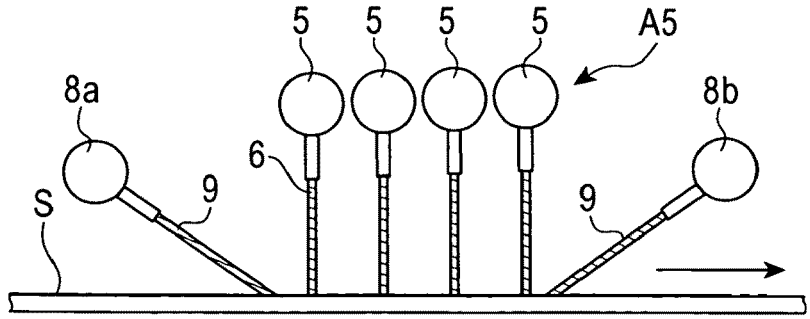
FIG. 8 is an explanatory diagram showing still another embodiment of cooling water purging means in the present invention.

FIG. 8 shows one of the embodiments. Ejecting nozzles 8*a* and 8*b* for a high-pressure fluid are respectively disposed on the upstream side and the downstream side of the strip processing line, relative to the position where cooling water is supplied from a group of nozzles A5 constituted by a plurality of the cooling water supply nozzles 5 for the laminar cooling or the jet cooling. A high-pressure fluid 9 is ejected, from obliquely above in the strip processing line direction with the ejecting nozzles 8*a* and 8*b*, to the cooling water that has been ejected from the group of nozzles A5 and has reached the upper side of the strip S. The cooling water is dammed up by the high-pressure fluid 9, which forces the cooling water to flow in the width directions of the strip. As a result, the cooling water is forcedly drained toward the outside of the strip in its side directions.

The above-mentioned water purging roller and high-pressure fluid may be used together as water purging means.

EXAMPLE

In the hot strip manufacturing line shown in FIG. 3, a hot strip was manufactured under the following conditions. A slab having a thickness of 240 mm was heated to 1200° C. in a furnace, rolled with a roughing stand so as to have a thickness of 35 mm, and further rolled with a group of finishing stands 1 so as to have a thickness of 3.2 mm. The rolled strip was cooled from 860° C. to 300° C. (desired cooling end temperature) on a first run out table 20 and a second run out table 21, and then wound with a coiler 3. In terms of material properties, the desired permissible deviation of the cooling end temperature was set to be within 60° C. throughout the overall length of the strip, preferably within 40° C.

Regarding cooling water supply nozzles 5 arrayed at the first run out table 20, round type laminar flow nozzles and spray nozzles were used for the upper side of the strip and the lower side of the strip, respectively. Cooling water was supplied with a water flow rate of 1000 L/min·m$^2$ except for Invention Example 12. The velocity at which the cooling water was ejected on the upper side of the strip was 4 m/sec. A mechanism that could adjust the temperature of the cooling water from room temperature to 90° C. was prepared to implement the cooling method disclosed in Patent Document 4.

At the second run out table 21, on the other hand, various types of nozzles could be arrayed in addition to the nozzles adopted at the first run out table 20, and a cooling water flow rate was also adjustable. Furthermore, systems and functions that could implement the methods in the related art (Patent Documents 1, 2, 4, and 5) were provided.

At the second run out table 21, the nozzle diameter was adjusted so as to generate a jet flow when the cooling water was obliquely ejected by inclining the nozzles as shown in FIGS. 5 and 7, or so as to generate a laminar flow when the cooling water was vertically ejected by directing the nozzles in a vertical direction as shown in FIGS. 6 and 8. The reason for this is as follows. For the round type nozzles, normally, a turbulent flow, that is, a jet flow is generated when the product of the nozzle diameter and the liquid flow rate is large, whereas a streamline flow, that is, a laminar flow is generated when the product is small. Therefore, any of the jet flow and the laminar flow can be selected by changing the nozzle diameter even if the flow rate is the same. In the case of ejecting cooling water by inclining the nozzles, the cooling water needs to obliquely penetrate a liquid layer on the upper side of the strip. The distance from the liquid layer surface to the strip is larger than the case of vertically ejecting cooling water, even if the liquid layer on the upper side of the strip has the same thickness. Thus, when cooling water is ejected by inclining the nozzles, a jet flow is used by adjusting the nozzle diameter to be relatively large so as to be able to penetrate the liquid layer. When cooling water is vertically ejected, a laminar flow is used by adjusting the nozzle diameter to be relatively small.

A plurality of cooling water supply nozzles 5 were arrayed in the longitudinal direction of a run out table 2, and each of the plurality of cooling water supply nozzles 5 was ON/OFF controlled. Radiation thermometers 10 were disposed between the group of finishing stands 1 and the first run out table 20, between the first run out table 20 and the second run out table 21, and between the run out table 2 and the coiler 3 so as to measure the temperatures in the longitudinal direction of the strip. To control the strip temperatures at exits of the first run out table 20 and the second run out table 21, differences between outputs of the radiation thermometers 10 and a desired temperature were calculated, and the number of the cooling water supply nozzles 5 used at the run out table 2 was adjusted within a single strip.

It was found during preadjustment that transition boiling occurred at about 500° C. with a water flow rate of 1000 L/min·m$^2$ and at about 600° C. with a water flow rate of 2000 L/min·m$^2$ when a strip was cooled with cooling water of 30° C. on the first run out table 20.

In the EXAMPLE, an average temperature in the longitudinal direction of the strip and temperature deviation defined by maximum temperature−minimum temperature in a single strip (coil) after cooling were examined. The results and the cooling conditions are shown in Tables 1 and 2.

Invention Example 1

At the first run out table 20, the rolled hot strip was cooled to 550° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 4 m/sec.

Figure 9:
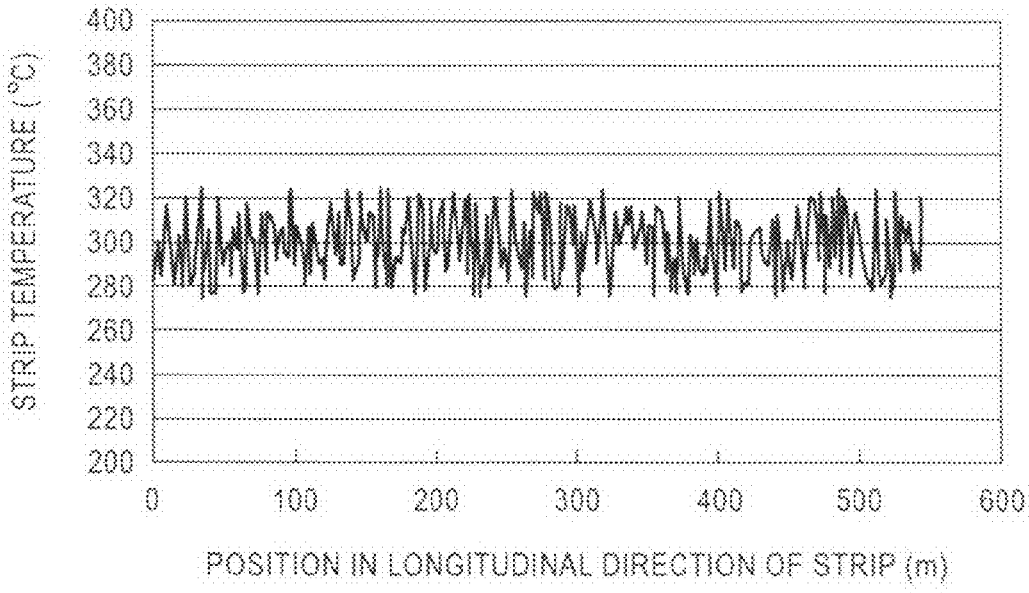
FIG. 9 is a temperature chart at an exit of a second run out table in a longitudinal direction of a strip in an invention example 1 of EXAMPLE.

In this invention example, the average temperature in the longitudinal direction of the strip after cooling was 302° C., which was substantially as desired. The temperature deviation of 50° C. in the longitudinal direction of the strip was also within the desired value. FIG. 9 is a temperature chart at the exit of the second run out table 21 in the longitudinal direction of the strip.

Invention Example 2

At the first run out table 20, the rolled hot strip was cooled to 550° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 3000 L/min·m$^2$ at both the upper and lower sides of the strip and the velocity at which the cooling water was ejected on the upper side of the strip was 4 m/sec.

In this invention example, the average temperature in the longitudinal direction of the strip after cooling was 303° C., which was substantially as desired. The temperature deviation of 40° C. in the longitudinal direction of the strip was also within the desired value, which was a preferable temperature range. The temperature deviation in the longitudinal direction of the strip became smaller than that in the invention example 1. This may be because the cooling water flow rate at the second run out table 21 was larger than that in the invention example 1.

Invention Example 3

At the first run out table 20, the rolled hot strip was cooled to 550° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 297° C., which was substantially as desired. The temperature deviation of 38° C. in the longitudinal direction of the strip was also within the desired value, which was a preferable temperature range. The temperature deviation in the longitudinal direction of the strip became smaller than that in the invention example 1. This may be because the performance of the cooling water of penetrating a liquid layer on the upper side of the strip was improved and stable nucleate boiling was caused to occur by increasing the velocity at which the cooling water was ejected at the second run out table 21 compared to the invention example 1.

Invention Example 4

At the first run out table 20, the rolled hot strip was cooled to 510° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2000 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 298° C., which was substantially as desired. The temperature deviation of 40° C. in the longitudinal direction of the strip was also within the desired value, which was a preferable temperature range.

Invention Example 5

At the first run out table 20, the rolled hot strip was cooled to 600° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2800 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 301° C., which was substantially as desired. The temperature deviation of 36° C. in the longitudinal direction of the strip was also within the desired value, which was a preferable temperature range.

Invention Example 6

At the first run out table 20, the rolled hot strip was cooled to 550° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 3000 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 297° C., which was substantially as desired. The temperature deviation of 25° C. in the longitudinal direction of the strip was also within the desired value, which was a preferable temperature range. The temperature deviation in the longitudinal direction of the strip became smaller than that in the invention example 1. This may be because stable nucleate boiling was caused to occur as with the reason described above by increasing the cooling water flow rate and the velocity at which the cooling water was ejected at the second run out table 21 compared to the invention example 1.

Invention Example 7

At the first run out table 20, the rolled hot strip was cooled to 550° C. with cooling water of 30° C. At the second run out table 21, the cooling water was then supplied by the laminar cooling to the upper side of the strip from the group of round type laminar flow nozzles 5A while being purged by the high-pressure fluid 9 ejected from the ejecting nozzles 8*a* and 8*b* as shown in FIG. 8. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 4 m/sec.

In this invention example, the average temperature in the longitudinal direction of the strip after cooling was 294° C., which was substantially as desired. The temperature deviation of 47° C. in the longitudinal direction of the strip was also within the desired value.

Invention Example 8

At the first run out table 20, the rolled hot strip was cooled to 550° C. with cooling water of 30° C. At the second run out table 21, the cooling water was then vertically supplied by the laminar cooling to the upper side of the strip from the group of round type laminar flow nozzles 5A while being purged by the high-pressure fluid 9 ejected from the ejecting nozzles 8*a* and 8*b* as shown in FIG. 8. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 308° C., which was substantially as desired. The temperature deviation of 38° C. in the longitudinal direction of the strip was also within the desired value, which was a preferable temperature range. The temperature deviation in the longitudinal direction of the strip became smaller than that in the invention example 7. This may be because the performance of the cooling water of penetrating the liquid layer on the upper side of the strip was improved and stable nucleate boiling was caused to occur by increasing the velocity at which the cooling water was ejected at the second run out table 21 compared to the invention example 7.

Invention Example 9

At the first run out table 20, the rolled hot strip was cooled to 550° C. with cooling water of 30° C. At the second run out table 21, the cooling water was then vertically supplied by the laminar cooling to the upper side of the strip from the group of round type laminar flow nozzles A3 while being purged by disposing respectively the water purging rollers 7*a* and 7*b* on the upstream side and the downstream side of the strip processing line relative to the position where cooling water is supplied as shown in FIG. 6. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 306° C., which was substantially as desired. The temperature deviation of 36° C. in the longitudinal direction of the strip was also within the desired value, which was a preferable temperature range.

Invention Example 10

At the first run out table 20, the rolled hot strip was cooled to 550° C. with cooling water of 30° C. At the second run out table 21, the cooling water was then obliquely supplied by the jet cooling to the upper side of the strip from the group of round type jet nozzles A4 obliquely directed to the downstream side of the strip processing line (the angle α relative to the surface of the strip is 45°) while being purged by disposing the water purging roller 7 on the downstream side of the strip processing line relative to the position where cooling water is supplied as shown in FIG. 7. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 7 m/sec.

In this invention example, the average temperature in the longitudinal direction of the strip after cooling was 302° C., which was substantially as desired. The temperature deviation of 37° C. in the longitudinal direction of the strip was also within the desired value, which was a preferable temperature range.

Invention Example 11

At the first run out table 20, the rolled hot strip was cooled to 550° C. with cooling water of 30° C. At the second run out table 21, the cooling water was then supplied by the jet cooling to the upper side of the strip from the two groups of slit type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 4 m/sec.

In this invention example, the average temperature in the longitudinal direction of the strip after cooling was 307° C., which was substantially as desired. The temperature deviation of 43° C. in the longitudinal direction of the strip was also within the desired value.

Invention Example 12

At the first run out table 20, the rolled hot strip was cooled to 650° C. with cooling water of 30° C. having a water flow rate of 2000 L/min·m$^2$ in the early stage, and then cooled to 550° C. with cooling water of 30° C. having a water flow rate of 1000 L/min·m$^2$ in the later stage. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2500 L/min·m$^2$ at both the upper and lower sides of the strip and the velocity at which the cooling water was ejected on the upper side of the strip was 4 m/sec.

In this invention example, the average temperature in the longitudinal direction of the strip after cooling was 303° C., which was substantially as desired. The temperature deviation of 45° C. in the longitudinal direction of the strip was also within the desired value.

Comparative Example 1

The rolled hot strip was cooled to 550° C. with cooling water of 30° C. at the first run out table 20, and then cooled at the second run out table 21. The laminar cooling was conducted on the upper side of the strip and the spraying cooling was conducted on the lower side of the strip throughout the run out table. The cooling water having a water flow rate of 1000 L/min·m$^2$ was supplied to the upper side of the strip at an ejection velocity of 4 m/sec. The cooling water having a water flow rate of 1000/min·m$^2$ was supplied to the lower side of the strip.

Figure 10:
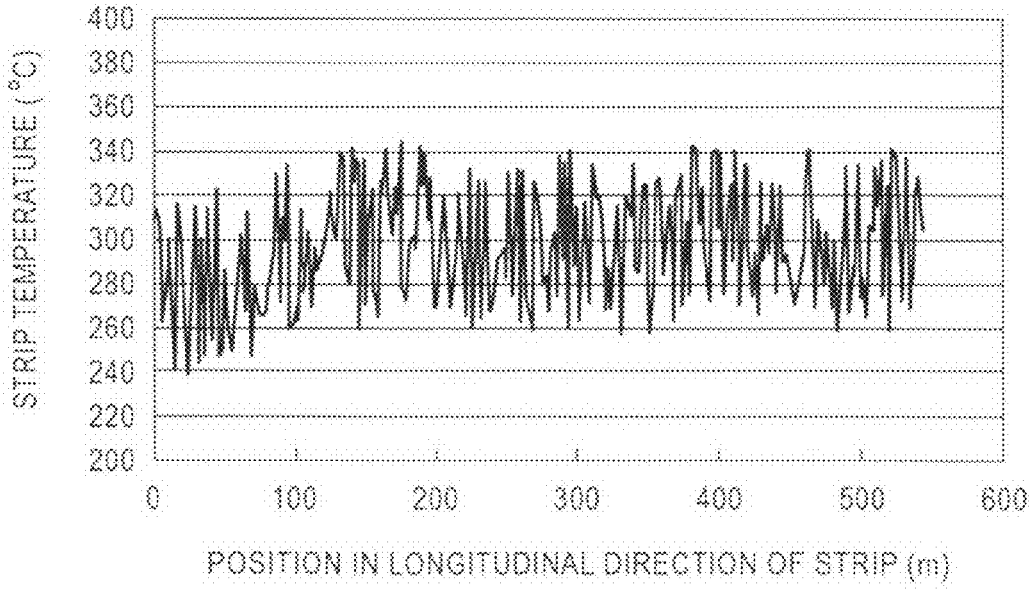
FIG. 10 is a temperature chart at an exit of a second run out table in a longitudinal direction of a strip in a comparative example 1 of EXAMPLE.

In this comparative example, the average temperature in the longitudinal direction of the strip after cooling was 280° C., which was 20° C. lower than the desired value. The temperature deviation of 80° C. in the longitudinal direction of the strip was larger than the desired value. FIG. 10 is a temperature chart at the exit of the second run out table 21 in the longitudinal direction of the strip.

Comparative Example 2

A hot strip was cooled in accordance with the method described in Patent Document 1. The rolled hot strip was cooled to 550° C. with cooling water of 30° C. at the first run out table 20, and then, only the lower side of the strip was cooled with the cooling water at the second run out table 21. The spraying cooling was conducted at the second run out table 21 and the cooling water having a water flow rate of 1000 L/min·m$^2$ was ejected to the lower side of the strip from spray nozzles.

In this comparative example, the average temperature in the longitudinal direction of the strip after cooling was 290° C., which was slightly lower than the desired value. However, the temperature deviation of 120° C. in the longitudinal direction of the strip was larger than the desired value. Even if only the lower side of the strip is cooled in the temperature range of 500° C. or less where thermal instability in cooling occurs, entering the temperature range of transition boiling cannot be prevented. Therefore, it is considered that the temperature was significantly lowered depending on the positions in the longitudinal direction of the strip.

Comparative Example 3

A hot strip was cooled in accordance with the method described in Patent Document 2. The rolled hot strip was cooled to 550° C. with cooling water of 30° C. at the first run out table 20, and then cooled with the cooling water of 90° C. at the second run out table 21. The laminar cooling was conducted on the upper side of the strip and the spraying cooling was conducted on the lower side of the strip throughout the run out table. At the second run out table 21, the cooling water having a water flow rate of 1000 L/min·m$^2$ was supplied and the velocity at which the cooling water was ejected on the upper side of the strip was 4 m/sec.

In this comparative example, the average temperature in the longitudinal direction of the strip after cooling was 290° C., which was slightly lower than the desired value. However, the temperature deviation of 70° C. in the longitudinal direction of the strip was larger than the desired value. Although the transition boiling initiation temperature was lowered by using hot water at the second run out table 21, the conversion from film boiling to transition boiling could not be prevented. Therefore, it is considered that the temperature variation in the longitudinal direction of the strip occurred.

Comparative Example 4

A hot strip was cooled in accordance with the method described in Patent Document 4. The rolled hot strip was cooled to 400° C. with cooling water of 80° C. at the first run out table 20, and then cooled with the cooling water of 30° C. at the second run out table 21. The laminar cooling was conducted on the upper side of the strip and the spraying cooling was conducted on the lower side of the strip throughout the run out table. At the second run out table 21, the cooling water having a water flow rate of 1000 L/min·m$^2$ was supplied and the velocity at which the cooling water was ejected on the upper side of the strip was 4 m/sec.

In this comparative example, the desired temperature at the exit of the first run out table was set to be 400° C. However, since the temperature in the longitudinal direction of the strip was fluctuated, the temperature deviation in the longitudinal direction of the strip was unfortunately 80° C. at this point. As a result of such temperature variation at the exit of the first run out table, the temperature variation in the longitudinal direction of the strip also occurred at the exit of the second run out table 21. Although the average temperature at the exit of the second run out table was 295° C. in the end, which was substantially as desired, the temperature deviation of 95° C. in the longitudinal direction of the strip was larger than the desired value. The transition boiling initiation temperature might be lowered by using hot water at the first run out table 20. However, the transition boiling initiation temperature was not lowered enough to cool the strip to 400° C. at the first run out table 20. Therefore, it is considered that the transition boiling occurred at the first run out table 20 and the temperature was significantly varied.

Comparative Example 5

A hot strip was cooled in accordance with the method described in Patent Document 5. The rolled hot strip was cooled to 550° C. with cooling water of 30° C. at the first run out table 20. Both the upper and lower sides of the strip were then cooled by the spraying cooling with the cooling water of 30° C. having a water flow rate of 200 L/min·m$^2$ at the second run out table 21.

In this comparative example, the average temperature in the longitudinal direction of the strip after cooling was 309° C., which was substantially as desired. However, the temperature deviation of 70° C. in the longitudinal direction of the strip was larger than the desired value. Although the transition boiling initiation temperature was lowered by decreasing the cooling water flow rate at the first run out table 20, the conversion of a cooling form from film boiling to transition boiling could not be prevented. Therefore, it is considered that the temperature variation after cooling occurred.

Comparative Example 6

At the first run out table 20, the rolled hot strip was cooled to 550° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 1500 L/min·m$^2$ at the upper side of the strip and 1800 L/min·m$^2$ at the lower side of the strip and the velocity at which the cooling water was ejected on the upper side of the strip was 4 m/sec.

In this comparative example, the average temperature in the longitudinal direction of the strip after cooling was 308° C., which was substantially as desired. However, the temperature deviation of 65° C. in the longitudinal direction of the strip was larger than the desired value. It is considered that stable nucleate boiling did not occur because the cooling water flow rate was low at the second run out table 21.

Comparative Example 7

At the first run out table 20, the rolled hot strip was cooled to 450° C. with cooling water of 30° C. At the second run out table 21, the cooling water was then supplied by the jet cooling to the upper side of the strip from the two groups of round type jet nozzles A1 and A2 as shown in FIG. 5, while obliquely facing the strip in a strip processing line direction. The cooling water was also supplied by the spraying cooling to the lower side of the strip. The cooling water used at the second run out table 21 had a temperature of 30° C. and a water flow rate of 2500 L/min·m$^2$ to both the upper and lower sides of the strip and the velocity at which the cooling water was ejected on the upper side of the strip was 4 m/sec.

In this comparative example, the average temperature in the longitudinal direction of the strip after cooling was 280° C., which was substantially as desired. However, the temperature deviation of 70° C. in the longitudinal direction of the strip was larger than the desired value. The temperature deviation at the first run out table in the longitudinal direction of the strip was 60° C., which meant the temperature deviation had already occurred at this point. Since the strip was cooled to 500° C. or less at the first run out table 20, the cooling form possibly changed from film boiling to transition boiling at the first run out table 20. Therefore, it is considered that even if the strip was cooled with a stable nucleate boiling state, the desired temperature deviation could not be achieved because of the temperature deviation that had already occurred at the first run out table 20.

TABLE 1

| | Run Out Cooling Method *1 *2 | | |
|---|---|---|---|
| Section | Cooling Water Flow Rate at First Run Out | Cooling Water Flow Rate and Velocity at Second Run Out *3 | Purging Method at Second Run Out |
| Invention Example 1 | U: Round Laminar 1000 L/min · m$^2$<br>L: Spraying 1000 L/min · m$^2$ | U: Round Jet 2500 L/min · m$^2$, Velocity 4 m/s<br>L: Spraying 2500 L/min · m$^2$ | FIG. 5 |
| Invention Example 2 | U: Round Laminar 1000 L/min · m$^2$<br>L: Spraying 1000 L/min · m$^2$ | U: Round Jet 3000 L/min · m$^2$, Velocity 4 m/s<br>L: Spraying 3000 L/min · m$^2$ | FIG. 5 |

TABLE 1-continued

| | | | |
|---|---|---|---|
| Invention Example 3 | U: Round Laminar 1000 L/min · $m^2$<br>L: Spraying 1000 L/min · $m^2$ | U: Round Jet 2500 L/min · $m^2$, Velocity 7 m/s<br>L: Spraying 2500 L/min · $m^2$ | FIG. 5 |
| Invention Example 4 | U: Round Laminar 1000 L/min · $m^2$<br>L: Spraying 1000 L/min · $m^2$ | U: Round Jet 2000 L/min · $m^2$, Velocity 7 m/s<br>L: Spraying 2000 L/min · $m^2$ | FIG. 5 |
| Invention Example 5 | U: Round Laminar 1000 L/min · $m^2$<br>L: Spraying 1000 L/min · $m^2$ | U: Round Jet 2800 L/min · $m^2$, Velocity 7 m/s<br>L: Spraying 2800 L/min · $m^2$ | FIG. 5 |
| Invention Example 6 | U: Round Laminar 1000 L/min · $m^2$<br>L: Spraying 1000 L/min · $m^2$ | U: Round Jet 3000 L/min · $m^2$, Velocity 7 m/s<br>L: Spraying 3000 L/min · $m^2$ | FIG. 5 |
| Invention Example 7 | U: Round Laminar 1000 L/min · $m^2$<br>L: Spraying 1000 L/min · $m^2$ | U: Round Laminar 2500 L/min · $m^2$, Velocity 4 m/s<br>L: Spraying 2500 L/min · $m^2$ | FIG. 8 |
| Invention Example 8 | U: Round Laminar 1000 L/min · $m^2$<br>L: Spraying 1000 L/min · $m^2$ | U: Round Laminar 2500 L/min · $m^2$, Velocity 7 m/s<br>L: Spraying 2500 L/min · $m^2$ | FIG. 8 |
| Invention Example 9 | U: Round Laminar 1000 L/min · $m^2$<br>L: Spraying 1000 L/min · $m^2$ | U: Round Laminar 2500 L/min · $m^2$, Velocity 7 m/s<br>L: Spraying 2500 L/min · $m^2$ | FIG. 6 |
| Invention Example 10 | U: Round Laminar 1000 L/min · $m^2$<br>L: Spraying 1000 L/min · $m^2$ | U: Round Jet 2500 L/min · $m^2$, Velocity 7 m/s<br>L: Spraying 2500 L/min · $m^2$ | FIG. 7 |

| | Temperature of Cooling Water | | Strip Temperature *4 | | | |
|---|---|---|---|---|---|---|
| | | | Temperature at Exit of First Run Out (° C.) | | Temperature at Exit of Second Run Out (° C.) | |
| Section | First Run Out (° C.) | Second Run Out (° C.) | Longitudinal Average | Longitudinal Deviation | Longitudinal Average | Longitudinal Deviation |
| Invention Example 1 | 30 | 30 | 550 | 25 | 302 | 50 |
| Invention Example 2 | 30 | 30 | 550 | 21 | 303 | 40 |
| Invention Example 3 | 30 | 30 | 550 | 26 | 297 | 38 |
| Invention Example 4 | 30 | 30 | 510 | 32 | 298 | 40 |
| Invention Example 5 | 30 | 30 | 600 | 17 | 301 | 36 |
| Invention Example 6 | 30 | 30 | 550 | 23 | 297 | 25 |
| Invention Example 7 | 30 | 30 | 550 | 24 | 294 | 47 |
| Invention Example 8 | 30 | 30 | 550 | 26 | 308 | 38 |
| Invention Example 9 | 30 | 30 | 550 | 23 | 306 | 36 |
| Invention Example 10 | 30 | 30 | 550 | 21 | 302 | 37 |

*1 U: Cooling conditions on the upper side of the strip
L: Cooling conditions on the lower side of the strip
*2 Round Laminar: Laminar cooling with round type nozzles
Spraying: Spraying cooling with spray nozzles
Round Jet: Jet cooling with round type nozzles
Slit Jet: Jet cooling with slit type nozzles
*3 Velocity: The velocity at which cooling water is ejected
*4 Longitudinal Average: Average temperature in the longitudinal direction of the strip
Longitudinal Deviation: Temperature deviation in the longitudinal direction of the strip

TABLE 2

| | Run Out Cooling Method *1 *2 | | |
|---|---|---|---|
| Section | Cooling Water Flow Rate at First Run Out | Cooling Water Flow Rate and Velocity at Second Run Out *3 | Purging Method at Second Run Out |
| Invention Example 11 | U: Round Laminar 1000 L/min · $m^2$<br>L: Spraying 1000 L/min · $m^2$ | U: Slit Jet 2500 L/min · $m^2$, Velocity 4 m/s<br>L Spraying 2500 L/min · $m^2$ | FIG. 5 |
| Invention Example 12 | (Early Stage)<br>U: Round Laminar 2000 L/min · $m^2$<br>L: Spraying 2000 L/min · $m^2$<br>(Later Stage)<br>U: Round Laminar 1000 L/min · $m^2$<br>L: Spraying 1000 L/min · $m^2$ | U: Round Jet 2500 L/min · $m^2$, Velocity 4 m/s<br>L: Spraying 2500 L/min · $m^2$ | FIG. 5 |
| Comparative Example 1 | U: Round Laminar 1000 L/min · $m^2$<br>L: Spraying 1000 L/min · $m^2$ | U: Round Laminar 1000 L/min · $m^2$, Velocity 4 m/s<br>L: Spraying 1000 L/min · $m^2$ | — |
| Comparative Example 2 | U: Round Laminar 1000 L/min · $m^2$<br>L: Spraying 1000 L/min · $m^2$ | U: None<br>L: Spraying 1000 L/min · $m^2$ | — |

TABLE 2-continued

| | | | |
|---|---|---|---|
| Comparative Example 3 | U: Round Laminar 1000 L/min · $m^2$<br>L: Spraying 1000 L/min · $m^2$ | U: Round Laminar 1000 L/min · $m^2$, Velocity 4 m/s<br>L: Spraying 1000 L/min · $m^2$ | — |
| Comparative Example 4 | U: Round Laminar 1000 L/min · $m^2$<br>L: Spraying 1000 L/min · $m^2$ | U: Round Laminar 1000 L/min · $m^2$, Velocity 4 m/s<br>L: Spraying 1000 L/min · $m^2$ | — |
| Comparative Example 5 | U: Round Laminar 1000 L/min · $m^2$<br>L: Spraying 1000 L/min · $m^2$ | L: Spraying 200 L/min · $m^2$<br>L: Spraying 200 L/min · $m^2$ | — |
| Comparative Example 6 | U: Round Laminar 1000 L/min · $m^2$<br>L: Spraying 1000 L/min · $m^2$ | U: Round Jet 1500 L/min · $m^2$, Velocity 4 m/s<br>L: Spraying 1800 L/min · $m^2$ | FIG. 5 |
| Comparative Example 7 | U: Round Laminar 1000 L/min · $m^2$<br>L: Spraying 1000 L/min · $m^2$ | U: Round jet 2500 L/min · $m^2$, Velocity 4 m/s<br>L: Spraying 2500 L/min · $m^2$ | FIG. 5 |

| | Temperature of Cooling Water | | Strip Temperature *4 | | | |
|---|---|---|---|---|---|---|
| | | | Temperature at Exit of First Run Out (° C.) | | Temperature at Exit of Second Run Out (° C.) | |
| Section | First Run Out (° C.) | Second Run Out (° C.) | Longitudinal Average | Longitudinal Deviation | Longitudinal Average | Longitudinal Deviation |
| Invention Example 11 | 30 | 30 | 550 | 25 | 307 | 43 |
| Invention Example 12 | 30 | 30 | 550 | 27 | 303 | 45 |
| Comparative Example 1 | 30 | 30 | 550 | 25 | 280 | 80 |
| Comparative Example 2 | 30 | 30 | 550 | 24 | 290 | 120 |
| Comparative Example 3 | 30 | 90 | 550 | 26 | 290 | 70 |
| Comparative Example 4 | 80 | 30 | 400 | 80 | 295 | 95 |
| Comparative Example 5 | 30 | 30 | 550 | 22 | 309 | 70 |
| Comparative Example 6 | 30 | 30 | 550 | 23 | 308 | 65 |
| Comparative Example 7 | 30 | 30 | 450 | 60 | 280 | 70 |

*1 U: Cooling conditions on the upper side of the strip
L: Cooling conditions on the lower side of the strip
*2 Round Laminar: Laminar cooling with round type nozzles
Spraying: Spraying cooling with spray nozzles
Round Jet: Jet cooling with round type nozzles
Slit Jet: Jet cooling with slit type nozzles
*3 Velocity: The velocity at which cooling water is ejected
*4 Longitudinal Average: Average temperature in the longitudinal direction of the strip
Longitudinal Deviation: Temperature deviation in the longitudinal direction of the strip

The invention claimed is:

1. A method for cooling a hot strip, which is obtained after a hot rolling process, by bringing cooling water into contact with the hot strip, the method comprising:

a first cooling step and a subsequent second cooling step, wherein, in the first cooling step, cooling is stopped at a strip surface temperature that is higher than a transition boiling initiation temperature and, in the subsequent second cooling step, cooling is conducted using cooling water having a water flow rate that causes nucleate boiling, and coiling is subsequently conducted, in the first cooling step, cooling is conducted using cooling water having a water flow rate of 350 to 1200 L/min·$m^2$ and is stopped at a strip surface temperature of more than 500° C., and in the second cooling step, cooling water having a water flow rate of 2500 L/min·$m^2$ or more is supplied to at least an upper side of the strip to decrease the strip surface temperature to 500° C. or less, and at least the upper side of the strip is cooled by laminar cooling or jet cooling while a velocity at which cooling water is ejected from cooling water supply nozzles by the laminar cooling or the jet cooling is 7 m/s or more.

2. The method for cooling a hot strip according to claim 1, wherein, in the first cooling step, cooling is stopped at a strip surface temperature of 550 to 600° C.

3. A method for cooling a hot strip, which is obtained after a hot rolling process, by bringing cooling water into contact with the hot strip, the method comprising:

a first cooling step and a subsequent second cooling step, wherein, in the first cooling step, cooling is stopped at a strip surface temperature that is higher than a transition boiling initiation temperature and, in the subsequent second cooling step, cooling is conducted using cooling water having a water flow rate that causes nucleate boiling, and coiling is subsequently conducted, in an early stage of the first cooling step, cooling is conducted using cooling water having a water flow rate of more than 1200 L/min·$m^2$ and, in a later stage of the first cooling step, cooling is conducted using cooling water having a water flow rate of 350 to 1200 L/min·$m^2$ and is stopped at a strip surface temperature of more than 500° C., and in the second cooling step, cooling water having a water flow rate of 2500 L/min·$m^2$ or more is supplied to at least an upper side of the strip to decrease the strip surface temperature to 500° C. or less, and at least the upper side of the strip is cooled by laminar cooling or jet cooling while a velocity at which cooling water is ejected from cooling water supply nozzles by the laminar cooling or the jet cooling is 7 m/s or more.

4. The method for cooling a hot strip according to claim 3, wherein, in the first cooling step, cooling is stopped at a strip surface temperature of 550 to 600° C.

5. The method for cooling a hot strip according to any one of claims 1 to 4, wherein, in the second cooling step, the cooling water supplied to the upper side of the strip is drained toward an outside of the strip in its side directions using water purging means.

6. The method for cooling a hot strip according to claim 5, wherein the water purging means is a roller disposed on the upper side of the strip in its width direction.

7. The method for cooling a hot strip according to claim 5, wherein the water purging means is a high-pressure fluid that is ejected to the cooling water on the upper side of the strip.

8. The method for cooling a hot strip according to any one of claims 1 to 4, wherein the cooling water is supplied to the upper side of the strip such that a stream of cooling water is ejected from each of two cooling water supply nozzles or from each of two groups of cooling water supply nozzles and collides with the upper side of the strip from obliquely above while obliquely facing the strip in a strip processing line direction, and both streams of the cooling water then collide with each other on a surface of the strip.

* * * * *